US011944254B2

(12) United States Patent
Thiyagarajan

(10) Patent No.: US 11,944,254 B2
(45) **Date of Patent: *Apr. 2, 2024**

(54) HOUSEHOLD APPLIANCES AND DRYING SYSTEMS THEREFOR

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 632 days.

This patent is subject to a terminal disclaimer.

(21) Appl. No.: 17/113,659

(22) Filed: Dec. 7, 2020

(65) Prior Publication Data

US 2022/0175213 A1 Jun. 9, 2022

(51) Int. Cl.
*A47L 15/48* (2006.01)
*A47L 15/42* (2006.01)

(52) U.S. Cl.
CPC ..... *A47L 15/483* (2013.01); *A47L 15/4291* (2013.01)

(58) Field of Classification Search
CPC ..... A47L 15/483; A47L 15/4921
USPC ..... 34/476
See application file for complete search history.

(56) References Cited

U.S. PATENT DOCUMENTS 7,757,521 B2 * 7/2010 Hong ..... D06F 25/00 68/20
8,875,721 B2 * 11/2014 Bertsch ..... A47L 15/483 134/107
11,278,180 B2 * 3/2022 Yoon ..... A47L 15/483
11,319,654 B2 * 5/2022 Malone ..... D06F 37/267
11,661,699 B2 * 5/2023 Welch ..... D06F 58/206 34/92
11,686,041 B2 * 6/2023 Del Maschio ..... D06F 34/18 34/595
2006/0254623 A1 11/2006 Classen
2013/0333238 A1 12/2013 Thiyagarajan
2018/0363223 A1 * 12/2018 Lee ..... D06F 39/12
2019/0046004 A1 2/2019 Thiyagarajan
2019/0360144 A1 * 11/2019 Sheeran ..... D06F 21/04
2020/0029784 A1 1/2020 Thiyagarajan et al.
2022/0175213 A1 * 6/2022 Thiyagarajan ..... A47L 15/4291
2023/0203745 A1 * 6/2023 Rajendran ..... D06F 58/22 34/85

FOREIGN PATENT DOCUMENTS

CN 109082817 A * 12/2018 ..... D06F 21/02
DE 102012209112 A1 12/2013
EP 2789284 B1 6/2019
WO WO2019/242240 A1 12/2019

* cited by examiner

*Primary Examiner* — Stephen M Gravini
(74) *Attorney, Agent, or Firm* — Dority & Manning, P.A.

(57) ABSTRACT

A dishwashing appliance includes a cabinet, a cabinet door for opening and closing the cabinet, a tub provided in the cabinet, the tub defining a wash chamber, an outlet defined at a first portion of the tub, an inlet defined at a second portion of the tub, an air flow duct defined between the inlet and the outlet, wherein air enters the air flow duct from the tub via the outlet and exits the air flow duct to the tub via the inlet, and an access panel removably attached to the air flow duct, the access panel defining a mounting plate protruding from an interior surface of the access panel.

20 Claims, 6 Drawing Sheets

HOUSEHOLD APPLIANCES AND DRYING SYSTEMS THEREFOR

FIELD OF THE INVENTION

The present subject matter relates generally to home appliances, and more particularly to drying systems for home appliances.

BACKGROUND OF THE INVENTION

Conventional home appliances (such as dishwashers, for example) operate to automatically clean household items (such as dishes, silverware, and glassware, for example). Some appliances also perform a drying operation on the items. Such drying operations rely on a supply of hot, dry air to be circulated through an area, such as a tub, containing the items. Accordingly, air may be circulated through the tub via one or more ducts containing one or more heat exchangers. These heat exchangers absorb heat and induce condensation of moisture from damp air, while resupplying the heat to the now dry air to be resupplied to the tub.

However, some conventional home appliances struggle with both proper assembly of heat exchangers and accessibility for maintenance of heat exchangers. For example, conventional heat exchangers are symmetrical, which may lead to improper assembly and faulty performance. For another example, conventional heat exchangers are typically installed in portions of appliances that are not easily accessible, leading to increased labor and costs to perform maintenance and/or replacement.

Accordingly, an improved drying system that obviates one or more of the above-mentioned drawbacks would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a cabinet door for opening and closing the cabinet, a tub provided in the cabinet, the tub defining a wash chamber, an outlet defined at a first portion of the tub, and an inlet defined at a second portion of the tub. An air flow duct may be defined between the inlet and the outlet, wherein air enters the air flow duct from the tub via the outlet and exits the air flow duct to the tub via the inlet. The dishwashing appliance may further include an access panel removably attached to the air flow duct, the access panel defining a mounting plate protruding from an interior surface of the access panel.

In another exemplary aspect of the present disclosure, a drying system is provided. The drying system may include a cabinet, a cabinet door for opening and closing the cabinet, a tub provided in the cabinet, the tub defining a wash chamber, an outlet defined at a first portion of the tub, and an inlet defined at a second portion of the tub. An air flow duct may be defined between the inlet and the outlet, wherein air enters the air flow duct from the tub via the outlet and exits the air flow duct to the tub via the inlet. The drying system may further include an access panel removably attached to the air flow duct, the access panel defining a mounting plate protruding from an interior surface of the access panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
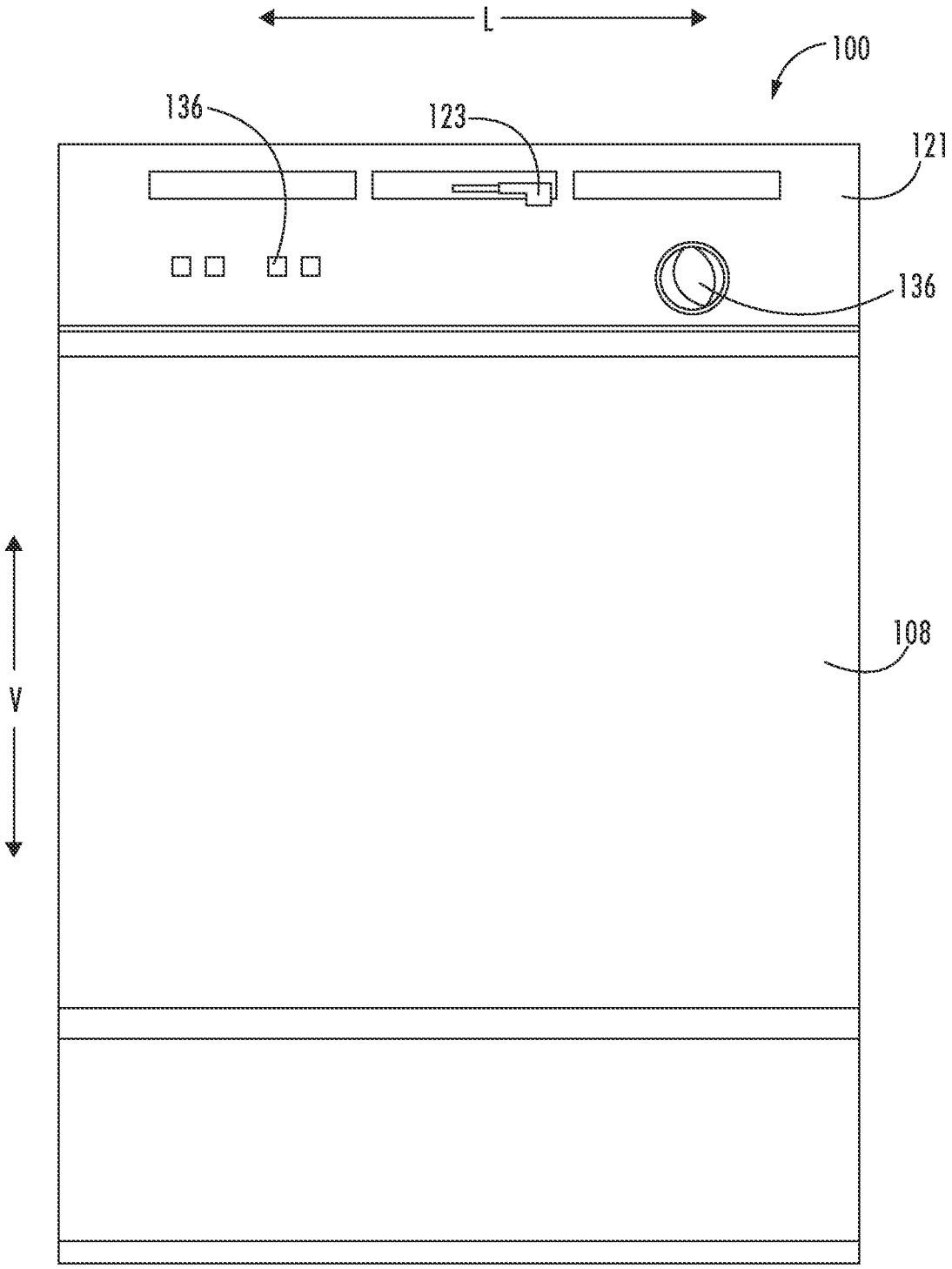
FIG. 1 illustrates a front view of an example dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
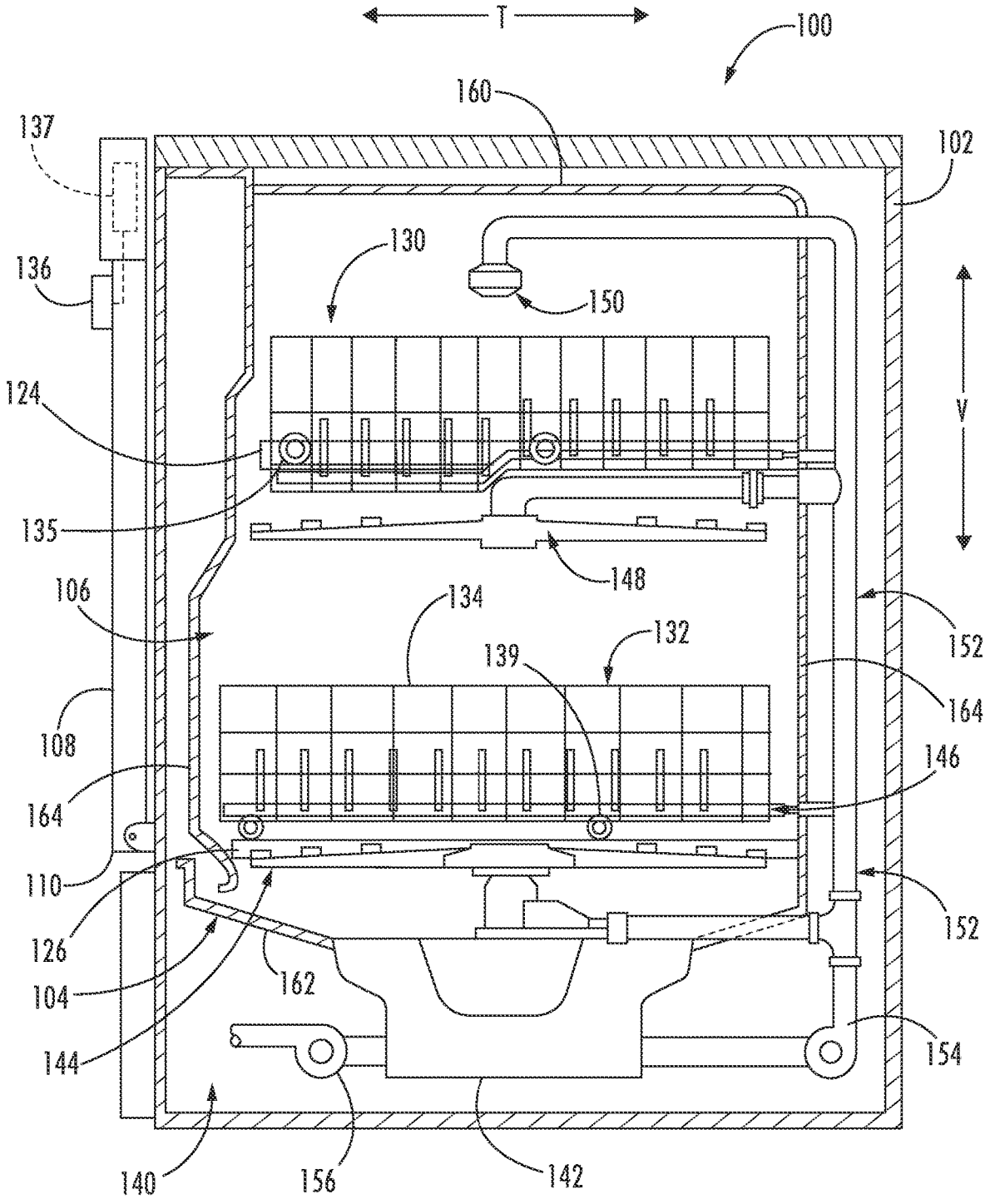
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
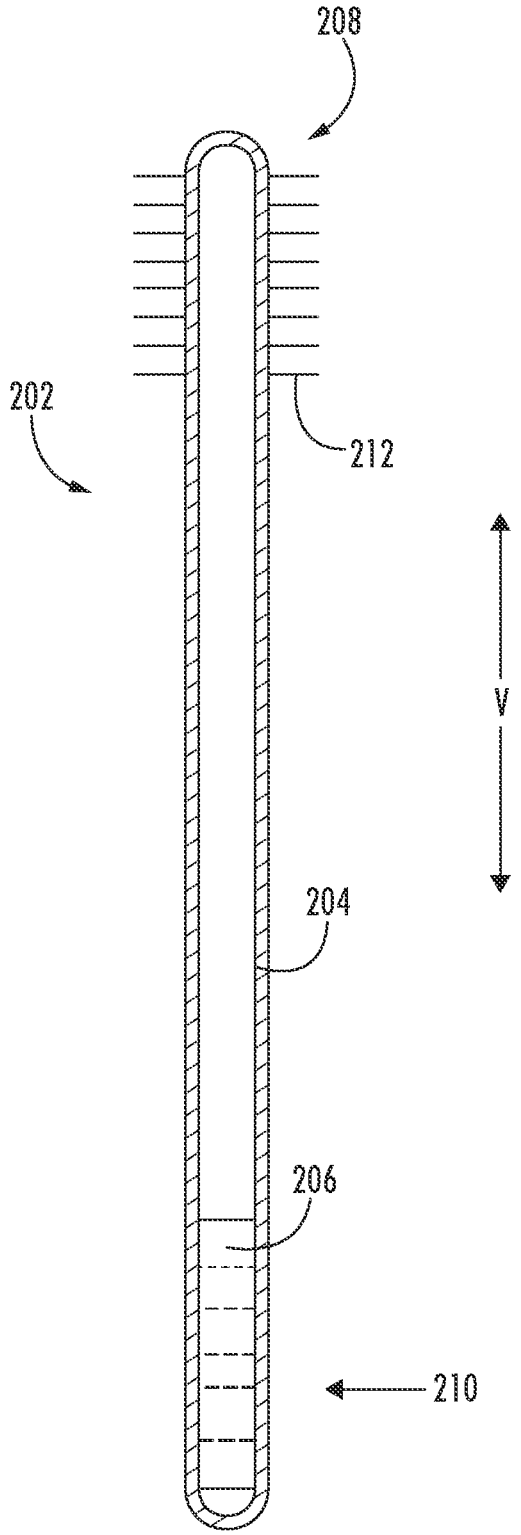
FIG. 3 provides a sectional view of an example heat pipe heat exchanger as may be incorporated in one or more embodiments of the present subject matter.

FIG. 3 illustrates an example heat pipe heat exchanger 202 which may be used as part of a heat exchanger 302 (FIG. 4) of a drying system 300 (FIG. 4) configured to promote drying of a wet chamber and/or of wet articles therein. A heat pipe heat exchanger, hereinafter referred to as a "heat pipe," is an efficient means of transferring thermal energy, e.g., heat, from one location to another. For example, in some embodiments, the heat pipe 202, as described in more detail hereinbelow, may be used to capture heat from a flow of hot, humid air at one end and the captured heat may be used to provide a flow of hot, dry air at the other end. For example, in some embodiments, the flow of hot, humid air may emanate from a wet chamber, e.g., the wet chamber may be the wash chamber 106 of dishwashing appliance 100 and wet articles, e.g., dishes, may be located therein.

As shown in FIG. 3, the heat pipe 202 includes a sealed casing 204 containing a working fluid 206 in the casing 204. In some embodiments, the working fluid 206 may be water. In other embodiments, suitable working fluids for the heat pipe 202 include acetone, glycol, methanol, ethanol, or toluene. In other embodiments, any suitable fluid may be used for working fluid 206, e.g., that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. The gaseous working fluid 206 condenses to a liquid state and thereby releases thermal energy at the condenser section 208. A plurality of fins 212 may be provided on an exterior surface of the casing 204 at one or both of the condenser section 208 and the evaporator section 210. The fins 212 may provide an increased contact area between the heat pipe 202 and air flowing around the heat pipe 202 for improved transfer of thermal energy. In one embodiment, as illustrated in FIG. 3, fins 212 are only provided at the condenser section 208.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, as illustrated in FIG. 3, the heat pipe 202 may be arranged such that the condenser section 208 is positioned above the evaporator section 210 along the vertical direction V whereby condensed working fluid 206 in a liquid state may flow from the condenser section 208 to the evaporator section 210 by gravity. In such embodiments, where the liquid working fluid 206 may return to the evaporator section 210 by gravity, the wick structure may be omitted. Thus, the embodiment of FIG. 3 may advantageously provide a reduced cost and simpler heat pipe 202 by omitting the wick structure.

FIGS. 4 through 7 and the associated description hereinbelow will provide examples of various embodiments of the drying system 300 implemented in a dishwashing appliance 100. It should be appreciated, however, that the exemplary drying system 300 is not necessarily limited to use in a dishwashing appliance 100. In additional embodiments, the drying system 300 may be provided in other appliances or devices, such as a clothes dryer appliance, desiccator, or any other appliance or device wherein drying is desired.

Figure 4:
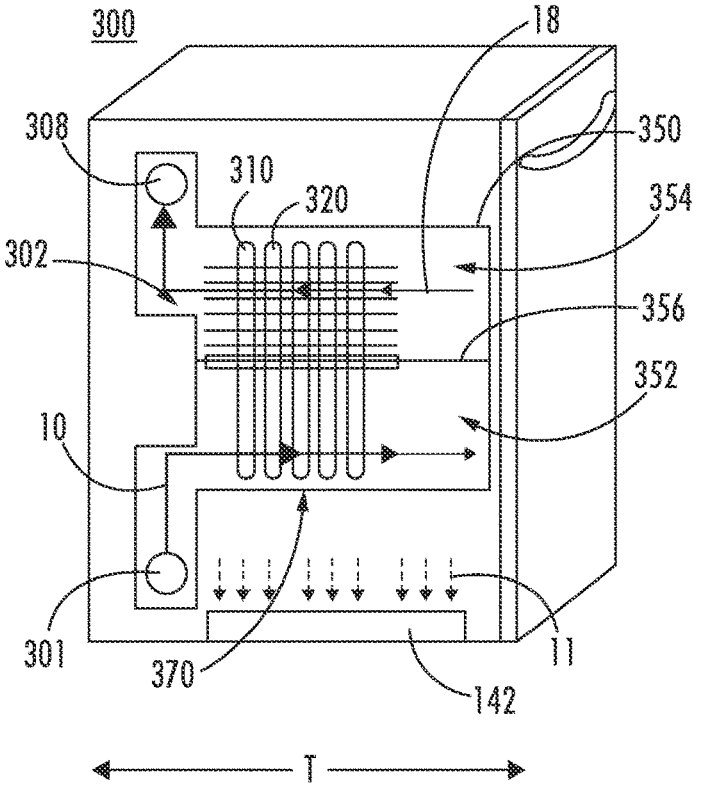
FIG. 4 provides a schematic view of a dishwashing appliance including a drying system according to one or more embodiments of the present subject matter.

Referring now to FIG. 4, the drying system 300 may include an outlet 301 and an inlet 308 defined in the tub 104. The outlet 301 may provide fluid communication between the wet chamber, e.g., the wash chamber 106 in embodiments where the drying system 200 is provided in a dishwashing appliance 100, and the heat exchanger 302. The heat exchanger 302 may include a plurality of heat pipes, each of which is generally similar to the exemplary heat pipe 202 illustrated in FIG. 3 and described above. For example, as shown in FIG. 4, the heat exchanger 302 includes a first heat pipe 310 and a second heat pipe 320. In some embodiments, the heat pipes may be separate and distinct elements, e.g., the heat exchanger 302 may include a plurality of discrete heat pipes, and the heat pipes may be spaced apart from one another. The heat pipes 310 and 320 may each have distinct operating temperatures and/or heating capacities. The heat pipes 310 and 320 are shown as having identical sizes, e.g., diameters, which is one example way to vary the operating temperature and/or capacity of the heat pipes. In other examples, the heat pipes 310 and 320 may have different sizes, e.g., diameters. Additionally or alternatively, the heat pipes 310 and 320 may also include different working fluids, different casing materials, and other variations, as well as or instead of different sizes to provide the distinct operating temperatures.

Figure 6:
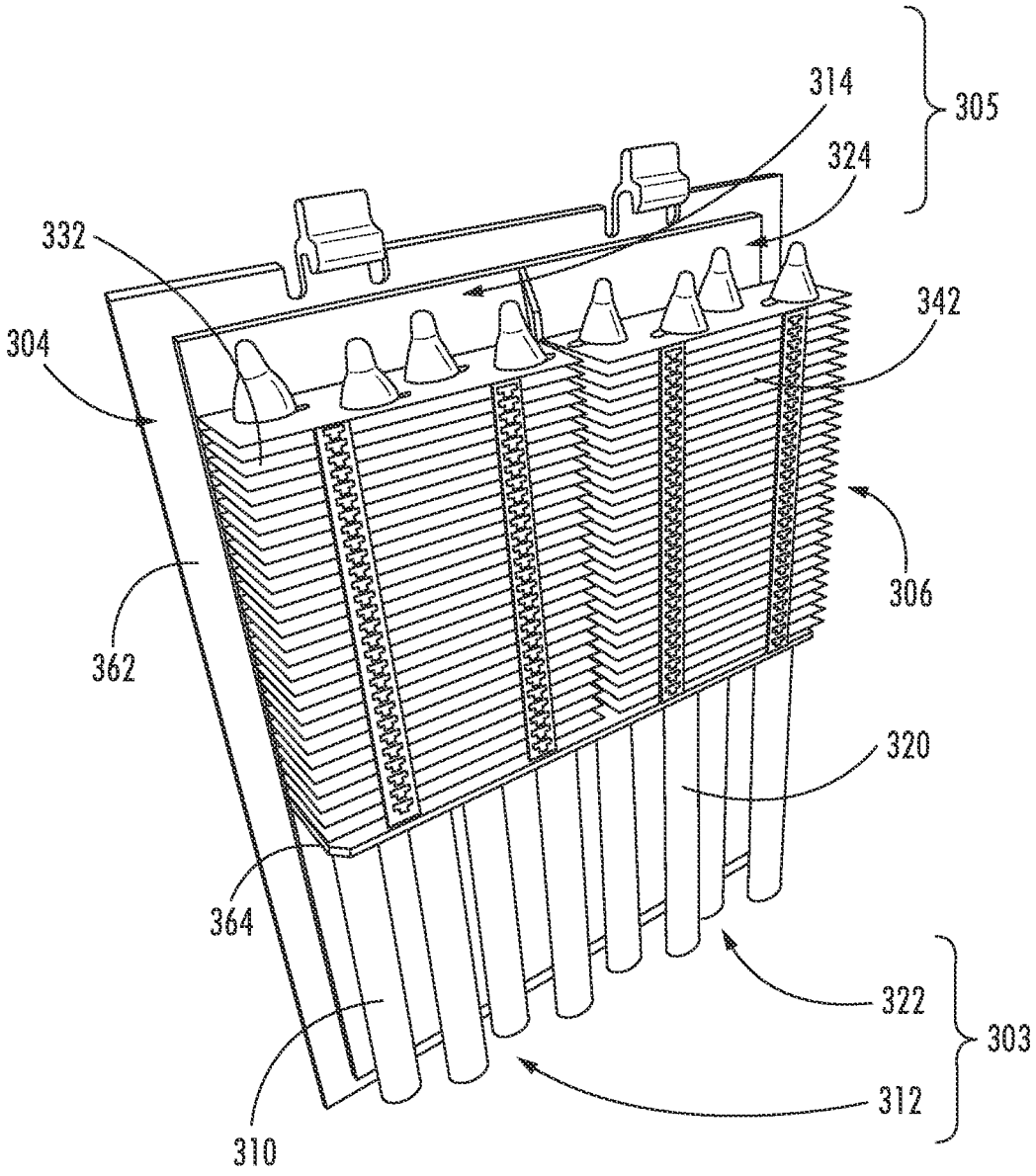
FIG. 6 provides a perspective view of the access door of FIG. 5 with a heat exchanger comprising a plurality of heat pipes, such as the example heat pipe heat exchanger of FIG. 3, attached thereto.

Heat exchanger 302 may be a single unit, or may include two or more units. For example, as shown in FIG. 6, heat exchanger 302 may include a first heat exchanger 304 and a second heat exchanger 306. First heat exchanger 304 may include first fins 332 and a first heat pipe 310 or a first plurality of heat pipes 310. Second heat exchanger 306 may include second fins 342 and a second heat pipe 320 or a second plurality of heat pipes 320. In the following discussion of particular exemplary embodiments, reference will be made to a single first heat pipe 310 and a single second heat pipe 320 for purposes of simplicity and by way of example only. It should be understood that references herein to a or the "first heat pipe 310" are intended to include embodiments with a single first heat pipe 310 or a first plurality of heat pipes 310, as well as references to a or the "second heat pipe 320" are intended to include embodiments with a single second heat pipe 320 or a second plurality of heat pipes 320. First heat pipe 310 and second heat pipe 320 may be the same (e.g., in diameter, material, working fluid, etc.). In some embodiments, first pipes 310 are different from second pipes 320 (e.g., in diameter, material, working fluid, etc.). Similarly, first fins 332 and second fins 342 may be the same (e.g., in planar area, distribution density, number, etc.). In some embodiments, first fins 332 are different from second fins 342 (e.g., in planar area, distribution density, number, etc.).

First heat exchanger 304 and second heat exchanger 306 may be arranged in a side-by-side manner. In detail, first heat exchanger 304 and second heat exchanger 304 may be arranged in sequence in a direction of air flow (e.g., over or through first fins 332 and second fins 342, or over first heat pipe 310 and second heat pipe 320). Accordingly, differing levels or amounts of heat exchange may be performed respectively by first heat exchanger 304 and second heat exchanger 306. For instance, first heat exchanger 304 may have first heat pipe 310 having a first diameter, and second heat exchanger 306 may have second heat pipe 320 having a second diameter, smaller than the first diameter. Advantageously, heat exchanger 302 may have a modular design to allow for variations in design, construction, and operation.

Each of the heat pipes 310 and 320 may include an evaporator section and a condenser section, similar to the evaporator section 210 and the condenser section 208 of the exemplary heat pipe 202 shown in FIG. 3 and described above. The evaporator sections 332 and 342 of the respective heat pipes 310 and 320 collectively define an evaporator section 303 of the heat exchanger 302. Similarly, the condenser sections 314 and 324 of the respective heat pipes 310 and 320 collectively define a condenser section 305 of the heat exchanger 302. The evaporator section 312 of the first heat pipe 310 may be immediately downstream of the outlet 301 and the condenser section 314 of the first heat pipe 310 may be downstream of the condenser section 324 of the second heat pipe 320 and immediately upstream of the inlet 308. As described below, the heat pipes 310 and 320 may be arranged in serial flow order, such that air flows from the evaporator section 312 of the first heat pipe 310 to the evaporator section 322 of the second heat pipe 320, etc., and air flows from the condenser section 324 of the second heat pipe 320 to the condenser section 314 of the first heat pipe 310, etc.

In operation, a flow of hot humid air 10 may be drawn from the wet chamber, e.g., wash chamber 106, into the drying system 300 via the outlet 301. For example, when the drying system 300 is implemented in dishwashing appliance 100, the hot humid air 10 may be drawn into the drying system 300 at the conclusion of a wet cycle of the dishwashing appliance 100 to promote drying of dishes or other articles located in rack assemblies 130 and 132 within the wash chamber 106. As used herein, "hot air" includes air having a temperature of at least about 100° F., such as between about 100° F. and about 160° F., such as between about 115° F. and about 155° F., such as about 135° F. As used herein, terms of approximation, such as "generally," or "about" include values within ten percent greater or less than the stated value. For example, "about 135° F." includes from 121.5° F. to 148.5° F. As used herein, "room temperature" includes temperatures between about 65° F. and about 75° F., such as between about 68° F. and about 72° F., such as about 70° F. As used herein, "dry air" includes air having a relative humidity of about thirty percent or less, such as less than about twenty percent, such as less than about ten percent, such as less than about five percent. As used herein, "humid air" includes air having a relative humidity greater than about eighty percent, such as greater than about ninety percent, such as about one hundred percent.

The hot humid air 10 may be a first flow of hot humid air 10, and may be directed, e.g., via a conduit or duct, from the outlet 301 to the evaporator section 303 of the heat exchanger 302. For example, in some embodiments, the evaporator section 312 of the first heat pipe 310 of the heat exchanger 302 may be in direct fluid communication with the outlet 301 such that the first flow of air 10 flows to and across (e.g., over and around) the evaporator section 312 of the first heat pipe 310. As shown, each of the heat pipes 310 and 320 includes fins at each of the respective condenser sections 314 and 324. In some embodiments, fins may not be provided at each of the respective evaporator section 312 and 322. The fins are not labelled in FIG. 4 for clarity, and it should be understood that each set of fins illustrated in FIG. 4 is similar to the fins 212 shown in FIG. 3 and described above.

Thus, the first flow of hot humid air 10 may flow across the evaporator section 312 of the first heat pipe 310, whereupon thermal energy from the first flow of hot humid air 10 is absorbed by working fluid (which is not specifically illustrated in FIG. 4, but is understood to be similar to working fluid 206 shown in FIG. 3 and described above) within the first heat pipe 310, and moisture in the first air flow 10 is released as condensation 11, which is drained, e.g., to sump 142. Thus, a second flow of air, which is at a lower temperature than the first flow of hot humid air 10, is provided to the evaporator section 322 of the second heat pipe 320. As the flow of air proceeds from evaporator section 312 of first heat pipe 310 to evaporator section 322 of second heat pipe 320, a heat and humidity level of the flow of air may be reduced. As shown in FIG. 4, condensation 11 may be formed (e.g., released from the air) at each stage of the evaporator section 303 of the heat exchanger 302, thereby lowering the moisture content at each stage, while the temperature is also lowered, such that the relative humidity remains about the same.

In some embodiments, such as the example embodiment illustrated in FIG. 4, the drying system 300 may be a closed loop system. In such embodiments, the evaporator section 303 of the heat exchanger 302 may be in direct fluid communication with the condenser section 305 of the heat exchanger 302. For example, a first flow of room temperature air may be provided directly from the evaporator section 322 of the second heat pipe 320 to the condenser section 324 of the second heat pipe 320. However, in some embodiments, evaporator section 303 and condenser section 305 may be separated by an air flow divider rib 356, which will be described in detail below.

The first flow of room temperature air may flow across (e.g., over and around) the condenser section 305 of the heat exchanger 302, including fins thereon in at least some embodiments. A second flow of room temperature air 18 may then flow from the condenser section 324 of the second heat pipe 320 to the condenser section 314 of the first heat pipe 310. The flow of air may continue sequentially through the condenser section 305 of heat exchanger 302, for example. A heat level of the air may subsequently be increased as it passes each sequential heat pipe 202, as described above. Thus, a second flow of hot dry air is then provided from the condenser section 305 of the heat exchanger 302, in particular the condenser section 314 of the first heat pipe 310, to the inlet 308, through which the flow of hot dry air may enter the wet chamber (e.g., wash chamber 106) to promote drying of articles therein. As explained above, fins 212 may be provided only on the condenser section 305 of the heat exchanger 302. Accordingly, a rate of heat exchange may be lower in the evaporator section 303 than in the condenser section 305. Advantageously, this may better regulate the temperature of the hot dry air entering wash chamber 106 via inlet 308, increasing a reliability and longevity of drying system 300.

Figure 7:
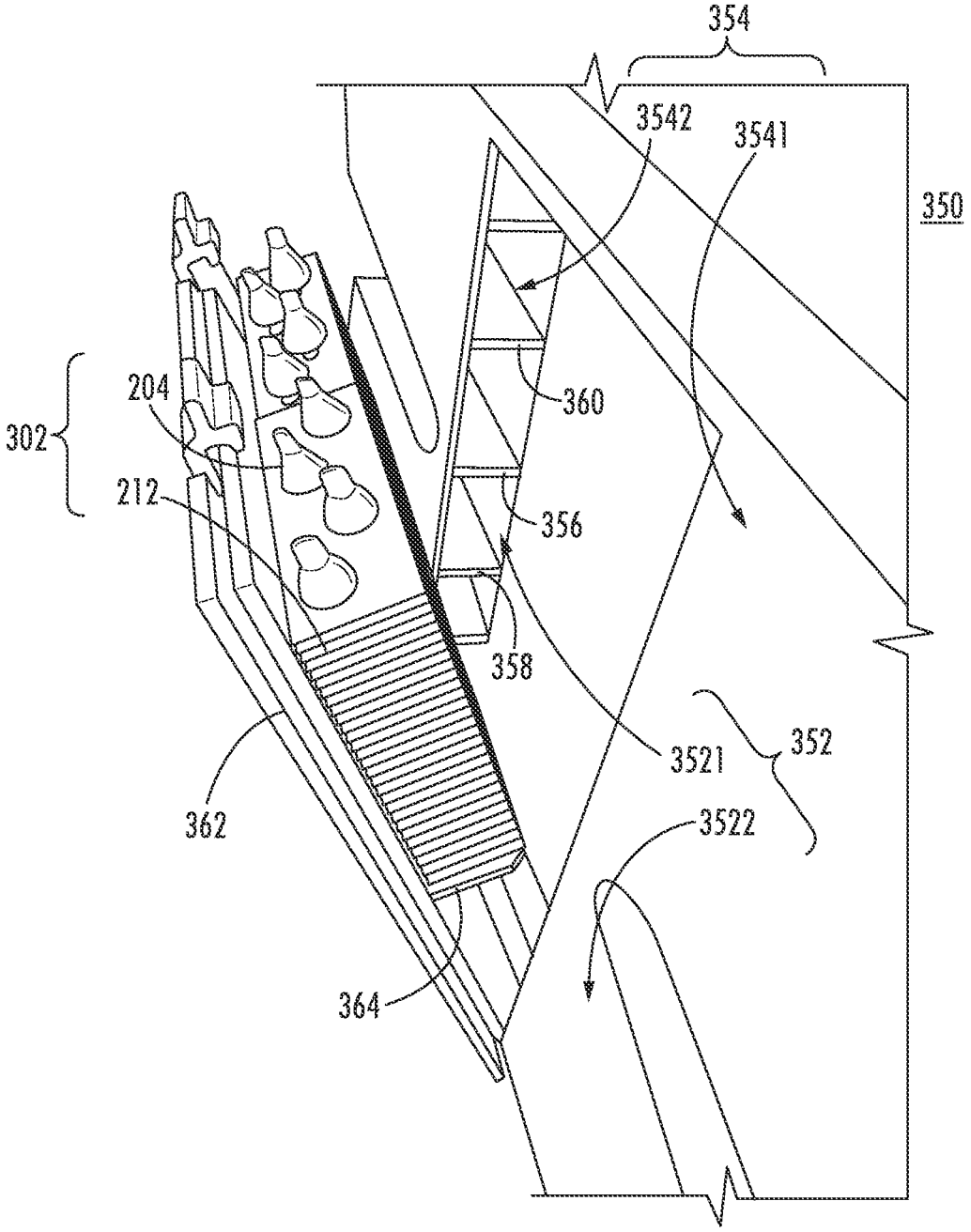
FIG. 7 provides a perspective view of an example air flow duct with the access door of FIG. 5 in an open position.

Referring now to FIG. 7, the appliance, e.g., dishwashing appliance 100, may include an air flow duct 350. Air flow duct 350 may be arranged between tub 104 and cabinet 102 of dishwashing appliance 100. In some embodiments, air flow duct 350 is provided in door 108. Air flow duct 350 may fluidly communicate with wash chamber 106 via outlet 301 and inlet 308. For instance, air from wash chamber 106 may flow into air flow duct 350 via outlet 301. Subsequently, air from air flow duct 350 may flow into wash chamber 106 via inlet 308. Accordingly, air may be circulated between wash chamber 106 and air flow duct 350 (e.g., during a drying operation).

Heat exchanger 302 may be provided within air flow duct 350. As shown in FIG. 4, heat exchanger 302 may be arranged such that heat pipes 202 extend in the vertical direction V. However, heat exchanger 302 may be arranged in any suitable orientation. Air flow duct 350 may include an evaporating air flow section 352 and a condensing air flow section 354. In detail, evaporating air flow section 352 may be separated from condensing air flow section 354 by an air flow divider rib 356. Air divider rib 356 may extend through air flow duct 350 in a direction substantially perpendicular to an axial direction of heat pipes 202. In one example, as illustrated in FIG. 4, air flow divider rib 356 extends in a horizontal direction (e.g., transverse direction T). In detail, air flow divider rib 356 may extend predominantly in an air flow direction within air flow duct 350.

Evaporating air flow section 352 may include an evaporating air flow rib 358. Evaporating air flow rib 358 may extend the length of evaporating air flow section 352 in the air flow direction. In some embodiments, evaporating air flow section 352 may be divided into a first portion 3521 and a second portion 3522. The first portion 3521 may be arranged upstream from heat exchanger 302. The second portion 3522 may be arranged downstream from heat exchanger 302. Thus, first portion 3521 and second portion 3522 may be separated by evaporator section 303 of heat exchanger 302. Evaporating air flow rib 358 may include a first evaporating air flow rib 3581 that extends an entire length of first portion 3521. Evaporating air flow rib 358 may include a second evaporating air flow rib 3582 that extends an entire length of second portion 3522. Evaporating air flow rib 358 may be parallel with air divider rib 356. Advantageously, evaporating air flow rib 358 may reduce turbulence within evaporating air flow section 352, resulting in smoother, e.g., more laminar, air flow.

Similarly, condensing air flow section 354 may include a condensing air flow rib 360. Condensing air flow rib 360 may extend the length of condensing air flow section 354 in the air flow direction. In some embodiments, condensing air flow section 354 may be divided into a first portion 3541 and a second portion 3542. The first portion 3541 may be arranged upstream from heat exchanger 302. The second portion 3542 may be arranged downstream from heat exchanger 302. Thus, first portion 3541 and second portion 3542 may be separated by condenser section 305 of heat exchanger 302. Condensing air flow rib 360 may include a first condensing air flow rib 3601 that extends an entire length of first portion 3541. Condensing air flow rib 360 may include a second condensing air flow rib 3602 that extends an entire length of second portion 3542. Condensing air flow rib 360 may be parallel with air divider rib 356 and evaporating air flow rib 358. Advantageously, condensing air flow rib 360 may reduce turbulence within condensing air flow section 354, resulting in smoother, e.g., more laminar, air flow and increased efficiency within dishwashing appliance.

Air flow duct 350 may include an access panel 362. Access panel 362 may provide selective access to an interior of air flow duct 350. Accordingly, access panel 362 may form a portion of a wall of air flow duct 350. Access panel 362 may be attached to air flow duct 350 via one or more hinges. For instance, a pair of hinges (not shown) may attach a bottom portion of access panel 362 to air flow duct 350. Additionally or alternatively, access panel 362 may be snap-fitted to air flow duct 350. It should be understood that any number of suitable attachment mechanisms may be used to removably attach access panel 362 to air flow duct 350, and the disclosure is not limited to those described herein. Accordingly, a user may remove access panel 362 to gain access to the interior of air flow duct 350.

Access panel 362 may include a mounting plate 364. Mounting plate 364 may protrude from an interior surface 366 of access panel 362. In some embodiments, mounting plate 364 protrudes into air flow duct 350 and extends in the horizontal direction (e.g., transverse direction T) along a width of access panel 362. For instance, mounting plate 364 may protrude from interior surface 366 of access panel 362 in the lateral direction L and may extend in the transverse direction T, when access panel 362 is in the closed position or fully attached position. Thus, mounting plate 364 may be colinear with air flow divider rib 356 when access panel 362 is in the closed position or fully attached position. In detail, mounting plate 364 may form a portion of air flow divider rib 356 when access panel 362 is in the closed position or fully attached position. Accordingly, mounting plate 364 may provide a delineation between evaporating air flow section 352 and condensing air flow section 354 together with air flow divider rib 356.

Figure 5:
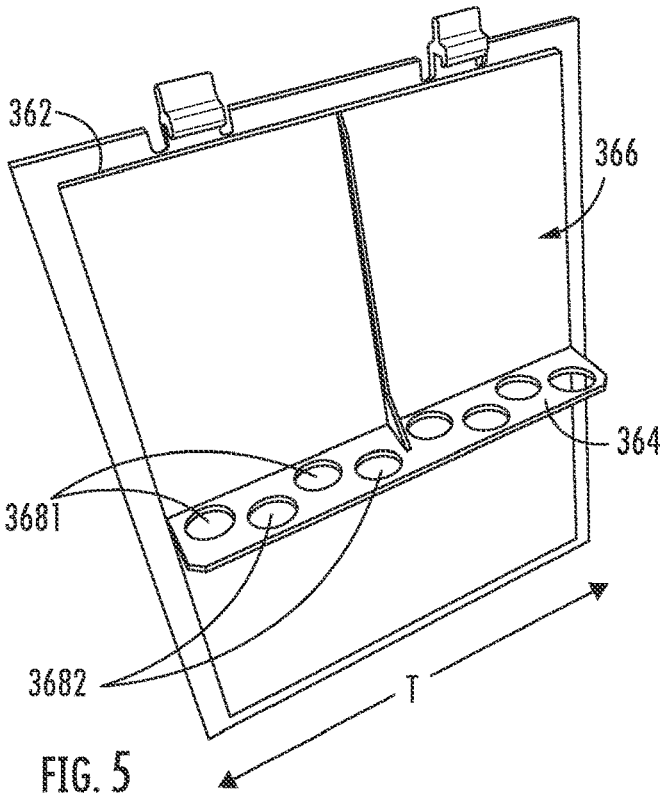
FIG. 5 provides a perspective view of an example access door according to one or more embodiments of the present subject matter.

As may be seen in FIG. 5, mounting plate 364 may have a plurality of mounting holes 368 defined therethrough. For instance, mounting holes 368 may be formed perpendicularly through the extending direction of mounting plate 364. In one example, mounting holes 368 are formed vertically through mounting plate 364. Additionally or alternatively, mounting holes 368 may be arranged in a zig-zag pattern along mounting plate 364. For example, a first set of mounting holes 3681 may be positioned closer to access panel 362 than a second set of mounting holes 3682. Accordingly, mounting holes 368 may be staggered in the air flow direction (e.g., transverse direction T in FIG. 5) of air flow duct 350 (e.g., a first mounting hole 3681 followed by a second mounting hole 3682, etc., in the air flow direction).

Mounting holes 368 may be sized so as to accept heat pipes 202 therethrough. In detail, a diameter of each mounting hole 368 may be within an engineering tolerance of a diameter of a respective heat pipe 202. In detail, mounting holes 368 may be configured to accept heat pipes 202 therethrough. For instance, during assembly of drying system 200, heat pipes 202 of heat exchanger 302 may be inserted into mounting holes 368 from an upper portion thereof. Thus, mounting holes 368 may be sized so as to provide stable support of heat exchanger 302 and restrict both a horizontal shifting of heat exchanger 302 as well as a passage of air flow between evaporating air flow section 352 and condensing air flow section 354.

As mentioned above, mounting holes 368 may be sized according to respective heat pipes 202 to be inserted therethrough. Accordingly, in an embodiment where each heat pipe 202 has the same diameter as every other heat pipe 202, each mounting hole 368 also has the same diameter as every other mounting hole 368. Similarly, in an embodiment where the heat pipes 202 have varying diameters, each mounting hole 368 may also have a different diameter (i.e., one mounting hole 368 may have a diameter configured to accept a corresponding heat pipe 202). Thus, mounting holes 368 may be sized according to specific applications to allow for different applications. Additionally or alternatively, mounting holes 368 may include gaskets (i.e., a different gasket for each mounting hole 368) that can be changed or replaced with different diameters to allow for modular construction.

Air flow duct 350 may further define a drain hole 370 therein (FIG. 4). Drain hole 370 may be formed at a bottom of evaporating air flow section 352, for example. Drain hole 370 may allow fluid communication between evaporating air flow section 352 and sump 142. In detail, condensation water 11 formed on evaporator section 303 of heat exchanger 302 may fall or flow to the bottom of evaporating air flow section 352 during a drying operation of dishwashing appliance 100. The condensation water 11 may then exit evaporating air flow section 352 via drain hole 370 and enter sump 142. Dishwashing appliance 100 may further include a conduit (not shown) that connects drain hole 370 with sump 142. Accordingly, condensation 11 may be easily drained from air flow duct 350 to sump 142.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet;

a cabinet door for opening and closing the cabinet;

a tub provided in the cabinet, the tub defining a wash chamber;

an outlet defined at a first portion of the tub;

an inlet defined at a second portion of the tub;

an air flow duct defined between the inlet and the outlet, wherein air enters the air flow duct from the tub via the outlet and exits the air flow duct to the tub via the inlet; and an access panel removably attached to the air flow duct, the access panel defining a mounting plate protruding from an interior surface of the access panel.

2. The dishwashing appliance of claim 1, wherein the mounting plate defines a plurality of mounting holes therethrough.

3. The dishwashing appliance of claim 2, wherein the plurality of mounting holes is arranged in a zig-zag pattern along the mounting plate.

4. The dishwashing appliance of claim 2, further comprising a heat exchanger provided in the air flow duct, wherein the heat exchanger comprises a plurality of heat pipes, each heat pipe having an evaporator section and a condenser section, and wherein the plurality of heat pipes is configured to be inserted into the plurality of mounting holes.

5. The dishwashing appliance of claim 4, wherein the heat exchanger comprises a plurality of fins in thermal contact with the plurality of heat pipes, and wherein the plurality of fins is provided only on the evaporator section of the plurality of heat pipes.

6. The dishwashing appliance of claim 1, wherein the air flow duct further comprises an air flow divider rib dividing the air flow duct into a condensing air flow section and an evaporating air flow section.

7. The dishwashing appliance of claim 6, further comprising:

a condensing air flow rib extending in an air flow direction of the condensing air flow section; and an evaporating air flow rib extending in an air flow direction of the evaporating air flow section.

8. The dishwashing appliance of claim 6, wherein the air flow duct defines a drain hole formed therethrough.

9. The dishwashing appliance of claim 8, wherein the drain hole is formed in the condensing air flow section of the air flow duct.

10. The dishwashing appliance of claim 1, wherein the air flow duct is provided in the cabinet door.

11. A drying system, comprising:

a cabinet;

a cabinet door for opening and closing the cabinet;

a tub provided in the cabinet, the tub defining a wash chamber;

an outlet defined at a first portion of the tub;

an inlet defined at a second portion of the tub;

an air flow duct defined between the inlet and the outlet, wherein air enters the air flow duct from the tub via the outlet and exits the air flow duct to the tub via the inlet; and an access panel removably attached to the air flow duct, the access panel defining a mounting plate protruding from an interior surface of the access panel.

12. The drying system of claim 11, wherein the mounting plate defines a plurality of mounting holes therethrough.

13. The drying system of claim 12, wherein the plurality of mounting holes is arranged in a zig-zag pattern along the mounting plate.

14. The drying system of claim 12, further comprising a heat exchanger provided in the air flow duct, wherein the heat exchanger comprises a plurality of heat pipes, each heat pipe having an evaporator section and a condenser section, and wherein the plurality of heat pipes is configured to be inserted into the plurality of mounting holes.

15. The drying system of claim 14, wherein the heat exchanger comprises a plurality of fins in thermal contact with the plurality of heat pipes, and wherein the plurality of fins is provided only on the evaporator section of the plurality of heat pipes.

16. The drying system of claim 11, wherein the air flow duct further comprises an air flow divider rib dividing the air flow duct into a condensing air flow section and an evaporating air flow section.

17. The drying system of claim 16, further comprising:

a condensing air flow rib extending in an air flow direction of the condensing air flow section; and an evaporating air flow rib extending in an air flow direction of the evaporating air flow section.

18. The drying system of claim 16, wherein the air flow duct defines a drain hole formed in the condensing section of the air flow duct.

19. The drying system of claim 11, wherein the air flow duct is provided in the cabinet door.

20. A drying system, comprising:

a cabinet;

a cabinet door for opening and closing the cabinet;

a tub provided in the cabinet, the tub defining a wash chamber;

an outlet defined at a first portion of the tub;

an inlet defined at a second portion of the tub;

an air flow duct defined between the inlet and the outlet, wherein air enters the air flow duct from the tub via the outlet and exits the air flow duct to the tub via the inlet; and an access panel removably attached to the air flow duct, the access panel defining a mounting plate protruding from an interior surface of the access panel, wherein the mounting plate defines a plurality of mounting holes therethrough.

* * * * *